US007686241B2

(12) United States Patent
Nakayama et al.

(10) Patent No.: US 7,686,241 B2
(45) Date of Patent: Mar. 30, 2010

(54) JAW CRUSHER AND SELF-TRAVELING CRUSHER

(75) Inventors: Tooru Nakayama, Hirakata (JP); Ryoichi Togashi, Hirakata (JP); Kouzo Suzuki, Hirakata (JP)

(73) Assignee: Komatsu Ltd., Tokyo (JP)

( * ) Notice: Subject to any disclaimer, the term of this patent is extended or adjusted under 35 U.S.C. 154(b) by 47 days.

(21) Appl. No.: 11/991,193

(22) PCT Filed: Aug. 24, 2006

(86) PCT No.: PCT/JP2006/316551

§ 371 (c)(1),
(2), (4) Date: Feb. 28, 2008

(87) PCT Pub. No.: WO2007/026589

PCT Pub. Date: Mar. 8, 2007

(65) Prior Publication Data

US 2009/0095833 A1 Apr. 16, 2009

(30) Foreign Application Priority Data

Aug. 29, 2005 (JP) ..... 2005-248047

(51) Int. Cl.
*B02C 1/00* (2006.01)

(52) U.S. Cl. ..... 241/101.74; 241/268

(58) Field of Classification Search ..... 241/264–269, 241/101.74
See application file for complete search history.

(56) References Cited

U.S. PATENT DOCUMENTS 7,124,971 B2 * 10/2006 Sugimura et al. ..... 241/269

(Continued)

FOREIGN PATENT DOCUMENTS

EP 1 424 132 A1 6/2004

(Continued)

OTHER PUBLICATIONS

International Preliminary Report on Patentability, Chapter I of the Patent Cooperation Treaty, and Written Opinion dated Sep. 9, 2008 for PCT/JP2006/316551. 4 sheets.

(Continued)

*Primary Examiner*—Mark Rosenbaum
(74) *Attorney, Agent, or Firm*—Frishauf, Holtz, Goodman & Chick, P.C.

(57) ABSTRACT

In a jaw crusher, cheek plates are mounted on side wall plates of a crusher frame by mounting bolts, and the mounting bolt adjacent to the outlet of the jaw crusher can be covered with the swing jaw by adjustment of an outlet gap-adjusting link mechanism. When the jaw crusher is in operation, the mounting bolt is covered by the swing jaw to avoid contact with raw materials, so that abrasion of and damages to the mounting bolt can be prevented. Thus, a longer lifetime of the jaw crusher can be promoted. Besides, since abrasion of and damages to the mounting bolt can be prevented, a mounting structure of the cheek plate can be stronger.

9 Claims, 5 Drawing Sheets

U.S. PATENT DOCUMENTS

| | | | |
|---|---|---|---|
| 7,168,644 | B2 | 1/2007 | Togashi et al. |
| 2003/0034412 | A1 | 2/2003 | Togashi et al. |
| 2004/0124295 | A1 | 7/2004 | Sugimura et al. |
| 2009/0152387 | A1 | 6/2009 | Nakayama et al. |

FOREIGN PATENT DOCUMENTS

| | | | |
|---|---|---|---|
| JP | 05-004824 | Y1 | 4/1930 |
| JP | 6-91182 | A | 4/1994 |
| JP | 7-9436 | | 2/1995 |
| JP | 2004-174450 | A | 6/2004 |
| JP | 2004-174452 | A | 6/2004 |
| KR | 20-0306703 | Y | 3/2003 |

OTHER PUBLICATIONS

Chinese Office Action dated May 15, 2009 (4 pages), and English translation thereof (5 pages), issued in counterpart Chinese Application Serial No. 2006800316046.

Korean Office Action dated Jun. 9, 2009 (3 pages), and English translation thereof (2 pages), issued in counterpart Korean Application Serial No. 10-2008-7004942.

* cited by examiner

JAW CRUSHER AND SELF-TRAVELING CRUSHER

This application is a U.S. National Phase Application under 35 USC 371 of International Application PCT/JP2006/316551 filed Aug. 24, 2006.

TECHNICAL FIELD

The present invention relates to a jaw crusher and a self-propelled crushing machine having the jaw crusher.

BACKGROUND ART

Conventionally, a jaw crusher that crushes raw materials by swinging a swing jaw against a fixed jaw is known. The fixed jaw and the swing jaw are supported by a crusher frame. Raw materials are thrown into a region surrounded by the fixed jaw, the swing jaw and the crusher frame, and then the swing jaw swings to crush the raw materials between the fixed jaw and the swing jaw. In such a jaw crusher, cheek plates are mounted to an inner surface of the crusher frame to prevent abrasion (e.g. see Patent Document 1).

[Patent Document 1] JP-A-06-91182 (FIG. 4)

DISCLOSURE OF THE INVENTION

Problems To Be Solved By the Invention

However, while the jaw crusher is in action, the cheek plates are rubbed against the raw materials, so that the cheek plates are heavily worn out after use of a long term, thereby causing abrasion of heads of bolts fitted in notches on the cheek plates and drop in fastening strength of the bolts. As a result, the mounting structure of the cheek plates weakens, and the lifetime of the bolts shortens.

An object of the present invention is to provide a jaw crusher with a stronger and more durable mounting structure of the cheek plates.

Means For Solving the Problems

A jaw crusher according to an aspect of the present invention includes: a fixed jaw; a swing jaw that swings with respect to the fixed jaw; an outlet gap-adjusting mechanism that adjusts an outlet gap between the fixed jaw and the swing jaw by changing a position of the swing jaw with respect to the fixed jaw; a crusher frame that supports the fixed jaw and the swing jaw; and a cheek plate mounted on an inner side of the crusher frame between the fixed jaw and the swing jaw by a mounting member, in which the outlet gap-adjusting mechanism has an adjustment range that can cover the mounting member disposed adjacent to the outlet by the swing jaw.

In the above arrangement, it is preferable that the outlet gap-adjusting mechanism is configured so that the swing jaw covers the mounting member when an outlet gap is in a state that the outlet gap takes during operation of the crusher jaw, and the mounting member is exposed when the outlet gap is in a state that the outlet gap takes during exchange of the cheek plate.

In the above arrangement, it is preferable that a self-propelled crushing machine includes the jaw crusher.

Effects of the Invention

According to the aspect of the invention, the outlet gap-adjusting mechanism has an adjustment range that can cover the mounting member disposed adjacent to the outlet gap of the cheek plate. Owing to the adjustment range, the swing jaw covers the mounting member when the outlet gap is in a state that the outlet gap takes during operation of the crusher jaw, and the mounting member is exposed when the outlet gap is in a state that the outlet gap takes during exchange of the cheek plate.

In other words, when the swing jaw takes a position that maximizes the outlet gap, the mounting member is exposed, and when the swing jaw takes a position that minimizes the outlet gap, the mounting member is covered by the swing jaw. Since the jaw crusher is used usually with the outlet gap adjusted smaller than the maximum of the outlet gap adjustment range, the mounting jaw is covered by the swing jaw during operation of the jaw crusher. Thus, abrasion of the mounting member is prevented because raw materials do not contact the mounting member during operation of the jaw crusher. Accordingly, the mounting member is provided with a longer lifetime, and the cheek plate and the jaw crusher are provided with a longer lifetime.

Further, since the mounting member is not directly contacted to raw materials, abrasion of and damages to the mounting member is prevented, so that decrease in the mounting strength of the cheek plate by the mounting member is prevented, thereby reinforcing the mounting structure of the cheek plate.

Furthermore, if the swing jaw is moved by the outlet gap adjustment mechanism to maximize the outlet gap, the mounting member is exposed. Thus, being detachable, the cheek plate can be exchanged if worn out after long use, thereby ensuring proper maintenanceability.

In addition to above, the outlet gap-adjusting mechanism preferably includes an actuator to be operated to adjust the outlet gap. Accordingly, changing the position of the swing jaw is facilitated. Thus, cheek plate-exchange work is simplified, so that downtime of the jaw crusher for exchange is reduced, thereby improving productivity.

According to the aspect of the present invention, since a self-propelled crushing machine includes the above-mentioned jaw crusher, the same effects as the above-mentioned jaw crusher are obtained, where abrasion of the mounting bolt is prevented, the mounting structure of the cheek plate is reinforced, and lifetimes of the jaw crusher and the self-propelled crushing machine are extended.

BEST MODE FOR CARRYING OUT THE INVENTION

Brief Description of Overall Arrangement

An embodiment of the present invention will be described below with reference to the figures.

Figure 1:
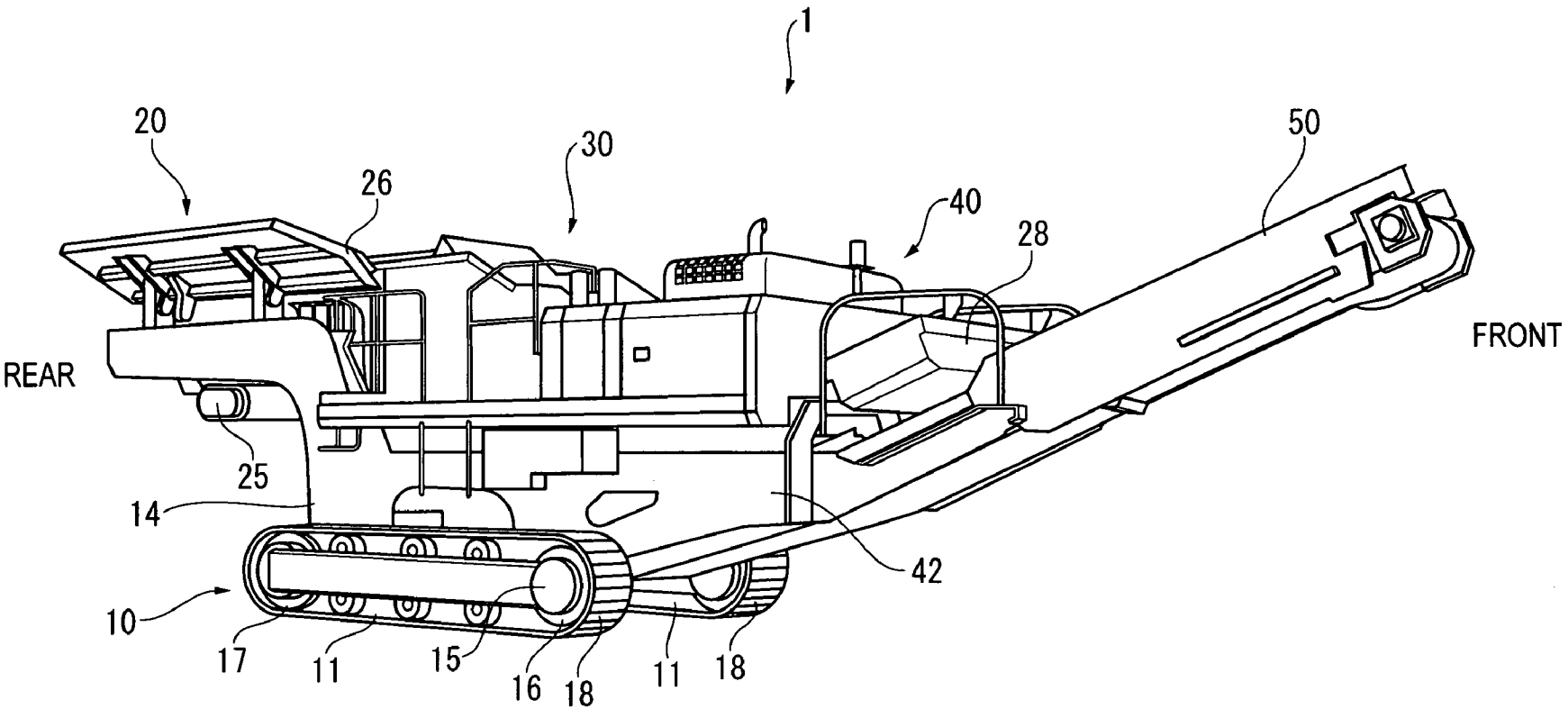
FIG. 1 is a perspective view showing a self-propelled crushing machine according to an embodiment of the present invention.

FIG. 1 is a perspective view showing a self-propelled crushing machine 1 according to the embodiment. For the convenience of explaining the embodiment, the right side of FIG. 1 represents a front side and the left side a rear side.

The self-propelled crushing machine 1 includes: a main unit 10 having a pair of lower traveling members 11; a feed unit 20 that is provided to a rear portion of an upper surface of the main unit 10 and supplied with raw materials; a jaw crusher 30 provided in front of the feed unit 20; a power unit 40 provided in front of the jaw crusher 30; and a discharge conveyor 50 extending forward and obliquely upward from a lower portion of the main unit 10 between a pair of crawlers 18.

The main unit 10 has a main frame (track frame) 14 including left and right side frames each continuous in the longitudinal direction and a plurality of link frames linking the side frames to each other. The lower traveling members 11 are respectively attached to the lower sides of the side frames. The lower traveling member 11 is constructed in an arrangement in which the crawler 18 is wound around a front sprocket wheel 16 driven by a hydraulic motor 15 and a rear idler tumbler 17.

In the feed unit 20, a grizzly feeder (not shown) driven by a vibrator 25 is mounted via a plurality of coil springs on the upper side of the frame protruding rearward. A hopper 26 is provided to the upper side of the grizzly feeder, covering the feeder from its three sides. Raw materials are thrown into the hopper 26 whose opening widens upward. Provided below the grizzly feeder is a discharge chute (not shown) which guides raw materials sorted and dropped by a grizzly feeder to the discharge conveyor 50 below.

Figure 2:
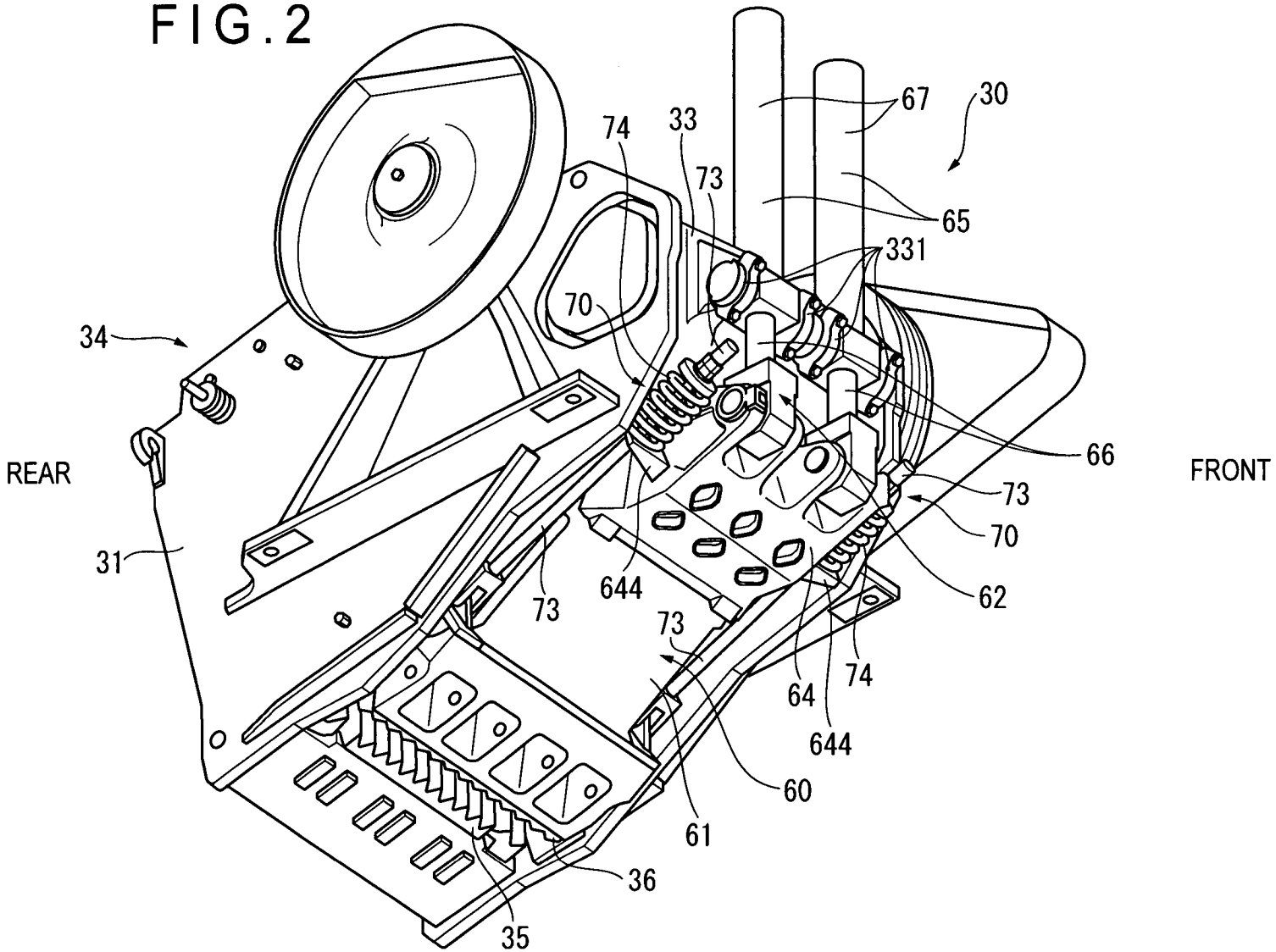
FIG. 2 is a perspective view showing a jaw crusher according to the embodiment.
Figure 3:
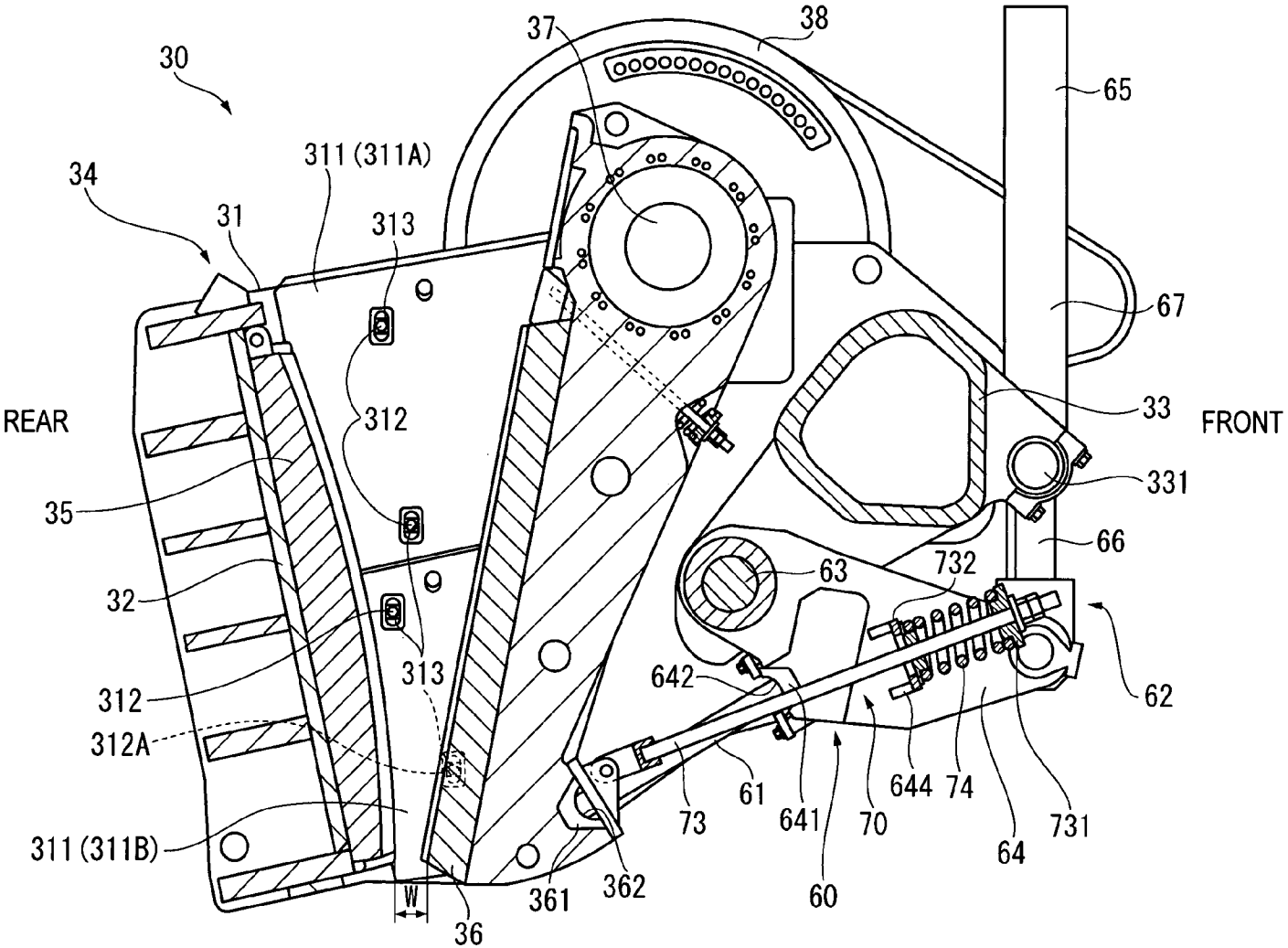
FIG. 3 is a side sectional view showing a jaw crusher according to the embodiment.

As shown in FIGS. 2 and 3, the jaw crusher 30 has a crusher frame 34 in which left and right side wall plates 31 are linked to each other by a rear wall plate 32 reinforced by a plurality of ribs and a cross member 33. A fixed jaw 35 is attached to the inner surface of the rear wall plate 32, and a swing jaw 36 whose tooth surface stands substantially vertically is disposed in front of the fixed jaw 35. The swing jaw 36 is hung at an upper side thereof on an eccentric part of a main shaft 37 rotatably bridged between the side wall plates 31, supported at a lower side thereof by a reaction force-receiving link mechanism 60 for receiving reaction force generated by crushing, and biased constantly toward the reaction force-receiving link mechanism 60 by a biasing mechanism 70.

The reaction force-receiving link mechanism 60 includes a link plate 61 having a first end engaged on a rear part of the swing jaw 36, a toggle link 64 that supports a second end of the link plate 61 and rotates about a toggle link pin 63, and lock cylinders 65 having lower ends pivoted on the toggle link 64. Each lock cylinder 65 is rotatably pivoted on the side of the cross member 33. An outlet gap W between the lower ends of the jaws 35 and 36 can be adjusted by advancing and retracting rods 66 of the lock cylinders 65. In other words, the reaction force-receiving link mechanism 60 constitutes an outlet gap-adjusting link mechanism (outlet gap adjustment mechanism) 62 in which the lock cylinders 65 are driven to move the swing jaw 36 toward and away from the fixed jaw 35 via the toggle link 64 and the link plate 61.

The biasing mechanism, a pair of which are disposed at two opposing sides of the reaction force-receiving link mechanism 60, substantially consists of a tension rod 73 having an end pivoted on the side of the swing jaw 36 and a tension spring 74 biasing the tension rod 73 in a predetermined direction. The tension rod 73 and the tension spring 74 are attached to the above mentioned toggle link 64.

In the jaw crusher 30 as described above, when a pulley 38 provided to an end of the main shaft 37 is driven by a hydraulic motor via a V-belt, the swing jaw 36 functions as a swinging link via the rotation of the main shaft 37 and crushes raw materials between the fixed jaw 35 and the swing jaw 36. Meanwhile, in the jaw crusher 30 according to the embodiment, the reaction force-receiving link mechanism 60 adopts a down-thrust type mechanism, so that the swing jaw 36 swings upward from downside on approaching the tooth surface of the fixed jaw 35.

As shown in FIG. 1, the power unit 40, on which an engine, a hydraulic pump, a fuel tank, an operating oil tank and the like are mounted via suitable mounting brackets and cross members, is mounted on a base frame 42. A control valve housed in a housing space of the power unit 40 distributes the hydraulic pressure from the hydraulic pump to the hydraulic motor in the lower traveling member 11, the vibrator 25 for the grizzly feeder, a hydraulic motor of the jaw crusher 30, a hydraulic motor for driving the discharge conveyor 50 and the like.

The discharge conveyor 50 discharges forward crushed materials dropped from the outlet of the jaw crusher 30 and drops them from a height. The dropped crushed materials are, for example, accumulated. If the raw materials contain foreign substances such as rebar and metal chips, a magnetic separator 28 can be mounted in front of the discharge conveyor 50 to remove the foreign substances. Instead of accumulating crushed materials from the discharge conveyor 50 on the ground, crushed materials may be carried to a remote place by secondary and tertiary conveyors and the like.

Detailed Description of Jaw Crusher

The details of the jaw crusher 30 will be explained below.

In FIGS. 2 and 3, the jaw crusher 30 has the fixed jaw 35 fixed to the rear wall plate 32, and the swing jaw 36 which swings relative to the fixed jaw 35, as described above. Provided on the rear surface of the swing jaw 36 are the reaction force-receiving link mechanism 60 which receives reaction force from the swing jaw 36, and the biasing mechanism 70 which biases the swing jaw 36 with a predetermined biasing force toward the reaction force-receiving link mechanism 60.

The reaction force-receiving link mechanism 60 includes a link having the link plate 61, toggle link 64, and lock cylinders 65, as described above.

As shown in FIG. 2, the link plate 61 is a plate shaped member which contacts the rear surface of the swing jaw 36 throughout substantially overall width of the jaw 36. The link plate 61 contacts the swing jaw 36 in an oblique downward direction from upside, so that the reaction force-receiving link mechanism 60 is of the down-thrust type. As shown in FIG. 3, an end of the link plate 61 contacts a contact portion 361 provided on the rear surface of the swing jaw 36. The other end of the link plate 61 contacts contact portions 641 provided on the toggle link 64. Thus, the link plate 61 is sandwiched between the swing jaw 36 and the toggle link 64. Concave portions 362 and 642 each having a substantially arc-like section are formed on the contact portions 361 and 641. The link plate 61 can swing about swinging centers which are the centers of the arcs of the concave portions 362 and 642.

The toggle link 64 provided inside the side wall plates 31 integrally includes an attachment portion 644 to which the tension spring 74 is attached. The toggle link 64 is pivoted on the toggle link pin 63, whose both ends are fixed to the side wall plates 31.

Each of the lock cylinders 65 are provided in front of the toggle link 64 and provided with the rod 66 and a cylinder body 67 for advancing and retracting the rod 66. Each lock cylinder 65 is arranged to stand with the rod 66 situated in the lower side of the cylinder body 67. The lower ends of the rods 66 are respectively pivoted on the front ends of the toggle link 64. A portion of each cylinder body 67 near the end thereof through which the rod 66 advances and retracts, i.e., the lower side (head side) of the cylinder body is rotatably supported by a support portion 331 of the cross member 33.

In each of these lock cylinders 65, the rod 66 or the piston at an end of the rod 66 interference-fits the cylinder body 67, and both of the rod 66 and the cylinder body 67 are usually locked. If hydraulic pressure is applied to the interference-fitted portions through the rods 66, the circumferential walls of the cylinder bodies 67 expand, reducing resistance between the cylinder bodies 67 and the rods 66. The lock is then released so that the rods 66 can advance and retract relative to the cylinder bodies 67. Therefore, the rods 66 can be locked at any suitable position in the cylinder bodies 67.

According to the reaction force-receiving link mechanism 60, the reaction force generated when raw materials are crushed is received by the toggle link pin 63 of the toggle link 64 and the support portions 331 of the cross member 33 via the link plate 61. As described above, if hydraulic pressure is applied between the pistons and the cylinder bodies 67 of the lock cylinders 65 to release the lock and if the rods 66 are advanced and retracted, the swing jaw 36 is moved toward and away from the fixed jaw 35 via the toggle link 64 and the link plate 61. In short, the reaction force-receiving link mechanism 60 also functions as the outlet gap-adjusting link mechanism 62.

As shown in FIG. 3, a pair of the biasing mechanisms 70 are provided to both sides of the toggle link 64, or in other words, to both sides in width direction of the swing jaw 36. As mentioned above, the biasing mechanism 70 includes the tension rod 73 and the tension spring 74.

A first end of the tension rod 73 is attached to the swing jaw 36. A second end of the tension rod 73 is arranged to penetrate the attachment portion 644 of the toggle link 64 into a forward and obliquely upward direction with respect to the position of the attached first end. The tension rod 73 is inserted into the tension spring 74, whose top end contacts a contact portion 731 screwed on the tension rod 73 and bottom end contacts a contact portion 732 fixed to the attachment portion 644, thereby biasing the tension rod 73 toward the toggle link 64 with a predetermined biasing force (tension). In short, the tension spring 74 biases the swing jaw 36 toward the toggle link 64 via the tension rod 73. This biasing force steadily holds the link plate 61 between the swing jaw 36 and the toggle link 64.

Operation of Jaw Crusher

The operation of the jaw crusher 30 will be explained below.

To begin with, when the hydraulic motor is driven to rotate the pulley 38 via the V-belt and further the main shaft 37, the swing jaw 36 pivoted on the eccentric part of the main shaft 37 swings. At this time, since the swing jaw 36 is supported at its lower side by the reaction force-receiving link mechanism 60 of the down-thrust type, the link plate 61 swings about the arc center of the concave portion 642 on the side of the toggle link 64 so that the swing jaw 36 swings to move toward and away from the fixed jaw 35. By this swinging movement, the swing jaw 36 and the fixed jaw 35 crush raw materials thrown between them and discharge crushed materials to the discharge conveyor 50 from the outlet gap W between the lower ends.

The reaction force received when the swing jaw 36 crushes raw materials is received by the toggle link pin 63 of the toggle link 64 and the support portion 331 of the cross member 33. If the reaction force received by the swing jaw 36 is too large, the interference-fitted portions of the lock cylinders 65 slide to prevent damages to the main portions of the jaw crusher 30.

Meanwhile, to change the grain size of crushed materials, the outlet gap-adjusting link mechanism 62 is operated. Hydraulic pressure is applied between the piston and the cylinder body 67 of the lock cylinder 65 to slightly expand the cylinder body 67 to reduce resistance therebetween and release the interference-fitted lock. When the rod 66 is advanced and retracted in this state by applying hydraulic pressure to the head side or bottom side of the cylinder body 67, the toggle link 64 rotates about the toggle link pin 63 in response. The link plate 61 then changes position thereof, so that the swing jaw 36 moves toward and away from the fixed jaw 35. The outlet gap W between the lower ends of the swing jaw 36 and the fixed jaw 35 is thus adjusted to change the grain size of the crushed materials.

On the inner surface of the side wall plate 31, a cheek plate 311 is attached to the substantially triangular region between the fixed jaw 35 and the swing jaw 36. The cheek plate 311 is formed in a plate of a predetermined thickness, which is divided into upper and lower plates, i.e. an upper cheek plate 311A and a lower cheek plate 311B. Since the cheek plate 311 is divided into the upper plate and lower plate, the lower cheek plate 311B, which is subject to severer abrasion due to constant contact with raw materials, can be separately exchanged. Therefore, the maintenanceability of the jaw crusher 30 can be improved, and the cost of the cheek plate 311 can be reduced. Projections (not shown) for guiding the cheek plate 311 are formed at both widthwise ends of the fixed jaw 35. Since the fixed jaw 35 is downwardly slanted toward the swing jaw 36, the projections are also formed in a slanted manner. The cheek plate 311 is contacted to and guided by the projection to roughly determine position thereof with respect to the side wall plate 31.

The cheek plate 311 is preferably made of a material having a high degree of anti abrasion. In the embodiment, high manganese cast steel is employed, which is also used for the fixed jaw 35 and the swing jaw 36.

In addition, on a surface of the cheek plate facing the side wall plate 31, recesses may be formed in a suitable manner for weight reduction of the cheek plate 311.

The upper cheek plate 311A is formed in a substantially trapezoidal shape in which the dimension of the upper portion is larger than the lower portion and is fixed to the side wall plate 31 by a plurality of (two in the embodiment) mounting bolts 312 and double nuts (not shown) from outside. In the upper cheek plate 311A, vertically elongated notches 313 extending in the vertical direction are formed at positions where mounting bolts 312 are to be disposed. Meanwhile, the head of the mounting bolt 312 is formed in a substantially rectangular shape, so that the head fits the notch 313 to avoid projecting from the surface of the cheek plate 311. Therefore, direct rubs between the mounting bolt 312 and raw materials are curtailed, so that abrasions of and damages to the mounting bolt 312 can be reduced. In addition, since the notch 313 is formed in a substantially rectangular shape, the notch 313 serves as a rotation restrainer for the mounting bolt 312.

Both of the mounting bolts 312 for the upper cheek plate 311A are disposed in the region between the fixed jaw 35 and the swing jaw 36 and exposed to the interior of the crush chamber. Since the upper cheek plate 311A is fixed to the side wall plate 31 at two points, misalignment of the upper cheek plate 311A in planar direction caused by force received from crush of raw materials can be prevented. Accordingly, the mounting structure of the upper cheek plate 311A by the mounting bolt 312 can be reinforced. In addition, since load applied to each of the mounting bolts 312 can be reduced, the mounting bolt 312 can be provided with a longer lifetime.

The lower cheek plate 311B is formed in a substantially trapezoidal shape in which the dimension of the upper portion is larger than the lower portion and is fixed to the side wall plate 31 by a plurality of (two in the embodiment) mounting bolts 312 and double nuts (not shown) from outside. The mounting bolts 312 are fitted into the elongate notches 313 formed on the lower cheek plate 311B in the same manner as the mounting bolts 312 in the upper cheek plate 311A. Accordingly, the heads of the mounting bolts 312 do not project from the surface of the lower cheek plate 311B, so that abrasion of and damages to the mounting bolts 312 can be reduced.

A first one of these mounting bolts 312 is disposed in the region between the fixed jaw 35 and the swing jaw 36 and exposed to the interior of the crush chamber.

During normal operation, the second one of the mounting bolts 312A disposed adjacent to the outlet of the jaw crusher 30 is covered by the swing jaw 36 and not exposed to the interior of the crush chamber.

Figure 4:
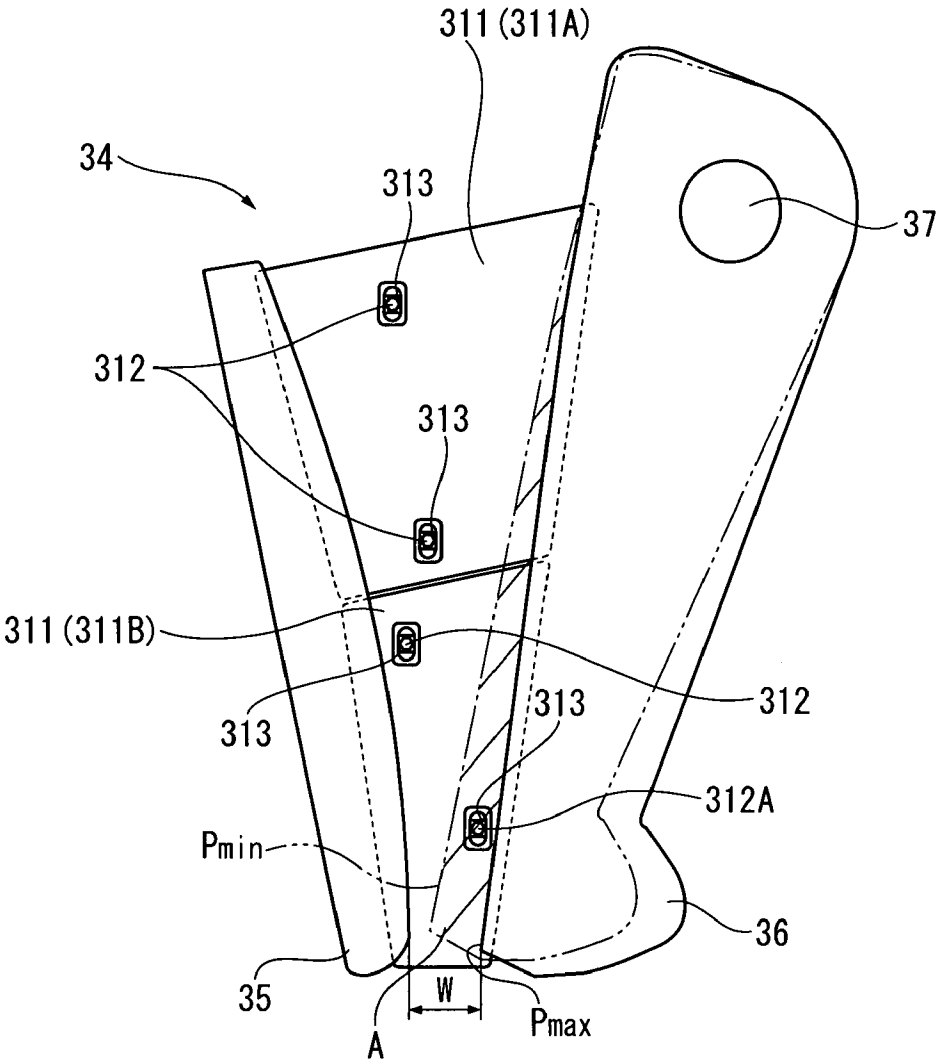
FIG. 4 is a figure showing positions of mounting members according to the embodiment.
Figure 5:
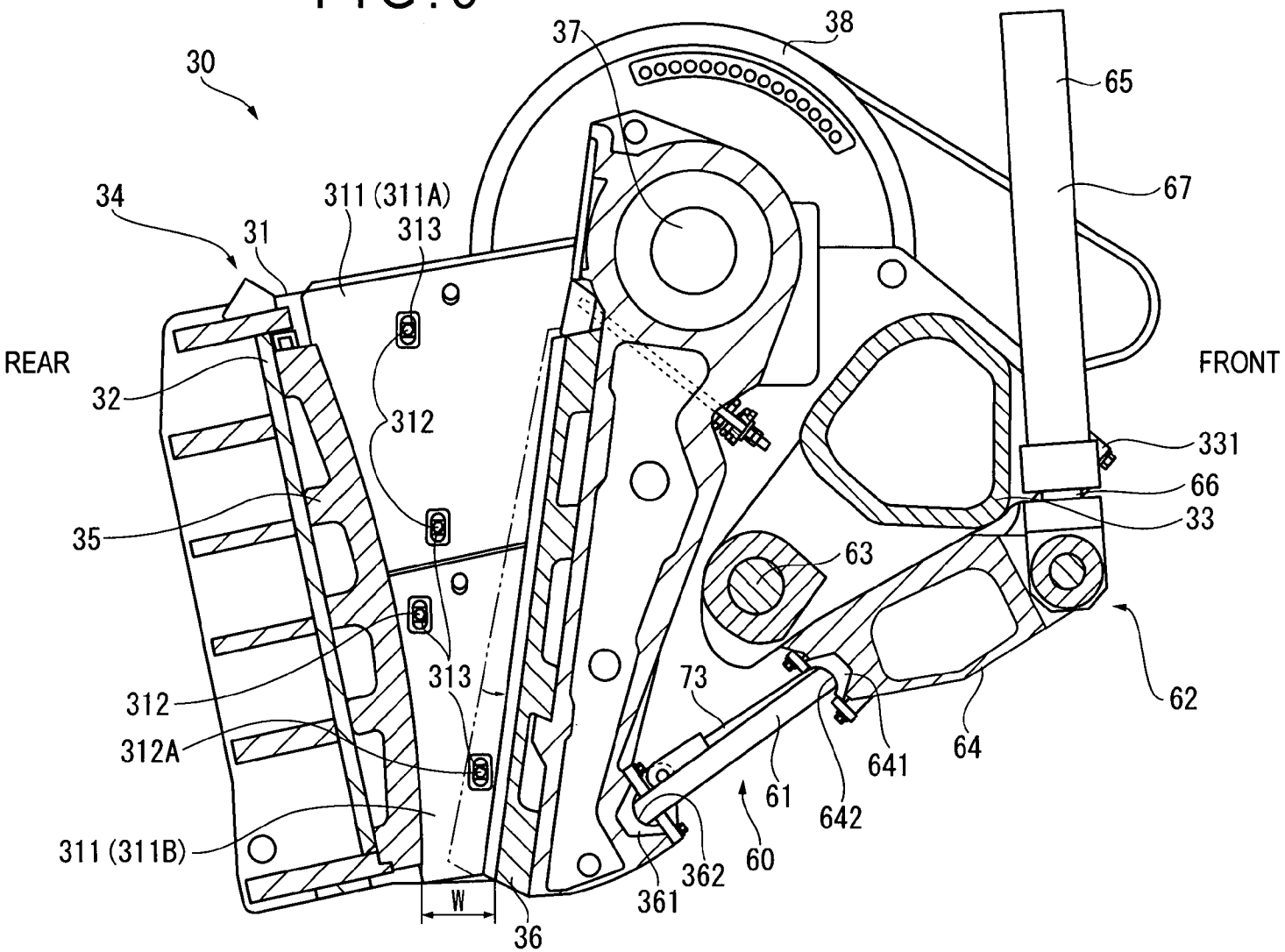
FIG. 5 is a side sectional view showing a jaw crusher according to the embodiment.

As shown in FIG. 4, the second mounting bolt 312A is disposed in a region that corresponds to the inner area of the range of the outlet gap adjustment of the swing jaw 36 by the outlet gap-adjusting link mechanism 62. In other words, in the cheek plate 311B, a region A is drawn by the trajectory of the swing jaw 36 between a position Pmax of an end of the swing jaw 36 that maximizes the outlet gap W and a position Pmin of an end of the swing jaw 36 that minimizes the outlet gap W, in which the second mounting bolt 312A adjacent to the outlet is disposed. As a result of such disposal, when the swing jaw 36 takes a position at the point Pmin that minimizes the outlet gap W, the second mounting bolt 312A is covered with the swing jaw 36 and not exposed to the interior of the crush chamber, and when the swing jaw 36 takes a position at the point Pmax that maximizes the outlet gap W, the second mounting bolt 312A is exposed to the interior of the crush chamber.

During normal operation of the jaw crusher 30, the outlet gap W is usually set smaller than the maximum, so that the second mounting bolt 312A is covered with the swing jaw 36 and not exposed to the interior of the crush chamber. Raw materials are thus prohibited from hitting the second mounting bolt 312A, thereby preventing abrasion of the second mounting bolt 312A. Consequently, a longer lifetime of the mounting bolt 312A is promoted. The lower cheek plate 311B markedly wears out particularly in an area adjacent to the outlet of the fixed jaw 35 and the swing jaw 36 against which raw materials are constantly rubbed. Thus, even if the mounting bolt 312A is housed in the notch 313, abrasion of the lower cheek plate 311B may lead to abrasion of the head of the mounting bolt 312A exposed between the fixed jaw 35 and the swing jaw 36. In the embodiment, since the second mounting bolt 312A is disposed at a position where covering by the swing jaw 36 does not allow rubbing by raw materials during normal operation, abrasion of and damages to the second mounting bolt 312A are effectively prevented.

Besides, since the lower cheek plate 311B is fixed by two (a plurality of) mounting bolts 312 and 312A, force received from crush of raw materials is not permitted to cause misalignment of the lower cheek plate 311B in planar direction. Accordingly, the mounting structure of the lower cheek plate 311B by the mounting bolts 312 and 312A can be reinforced. In addition, since load applied to each of the mounting bolts 312 and 312A can be reduced, longer duration of the mounting bolts 312 and 312A is promoted.

On exchanging the cheek plate 311, the outlet gap-adjusting link mechanism 62 is manipulated to set the outlet gap W between the lower ends of the swing jaw 36 and the fixed jaw 35 at the maximum of the adjustable range. The mounting bolt 312A of the lower cheek plate 311B is then exposed between the fixed jaw 35 and the swing jaw 36, where the mounting bolt 312A and subsequently the cheek plate 311 can be readily removed. Since the outlet gap-adjusting link mechanism 62 can be hydraulically operated via the lock cylinder 65, even if the mounting bolt 312A is covered with the swing jaw 36, the swing jaw 36 can be easily moved. Therefore, durability of the mounting bolt 312 can be reserved, and removal of the cheek plate 311 can be worked out simply. Consequently, time for exchanging the cheek plate 311 can be shortened, and maintenanceability and productivity of the jaw crusher 30 can be improved.

It should be noted that the present invention is not limited to the above embodiment, but includes modifications, improvements and the like as far as an object of the present invention can be achieved.

The cheek plate is not limited to being divided into two plates, but may be, for example, divided into three or more plates or constituted by a single plate, undivided, according to dimensions or use conditions of the jaw crusher.

The mounting member is not limited to being provided to two points in each cheek plate, but may be of any suitable number. In addition, if the mounting member is provided in a plurality, a suitable number of the mounting members may be disposed within the outlet gap adjustment range of the outlet gap-adjusting mechanism.

On exchanging the cheek plate, the outlet gap need not be widened to the maximum, but may be widened to a position enough to expose the mounting member. Since such a method can shorten operation time of the outlet gap-adjusting mechanism, exchange time of the cheek plate can be shortened.

The actuator of the outlet gap-adjusting mechanism is not limited to be hydraulically driven, but may be driven in any manner, e.g. electrically. In addition, the outlet gap-adjusting mechanism is not limited to having an actuator, but effects of the present invention can still be obtained by an outlet gap-adjusting mechanism not having an actuator, which can at least allow an exchange of the cheek plate though the adjustment of the outlet gap would take time.

The best arrangements, methods and the like for implementation of the present invention has been disclosed above, but the present invention is not limited to such. In other words, though the present invention is specifically shown in figures and explained mainly with regard to a particular embodiment, those skilled in the art can variously modify the shape, material, amount and other detailed arrangements of the above embodiment without departing from the technical ideas and scope of the objects of the present invention.

Therefore, because the above-disclosed description limiting the shape, material and the like is merely an exemplified statement for facilitating understanding of the present invention and is not a limitation on the present invention, a statement using names of the members on which a part of or all of the limitations regarding the shape, material, and the like is eliminated is included in the present invention.

The invention claimed is:

1. A jaw crusher, comprising:

a fixed jaw;

a swing jaw that swings with respect to the fixed jaw;

an outlet gap-adjusting mechanism that adjusts an outlet gap between the fixed jaw and the swing jaw by changing a position of the swing jaw with respect to the fixed jaw;

a crusher frame that supports the fixed jaw and the swing jaw;

a cheek plate; and a mounting member that mounts the cheek plate on an inner side of the crusher frame between the fixed jaw and the swing jaw, wherein the outlet gap-adjusting mechanism has an adjustment range and is configured to change the position of the swing jaw with respect to the fixed jaw and thereby adjust the outlet gap such that, in the adjustment range of the outlet gap-adjusting mechanism, the swing jaw covers the mounting member during operation of the jaw crusher, and the swing jaw does not cover the mounting member during exchange of the cheek plate.

2. A self-propelled crushing machine comprising:

a traveling member; and a jaw crusher provided on the traveling member;

the jaw crusher comprising:

a fixed jaw;

a swing jaw that swings with respect to the fixed jaw;

an outlet gap-adjusting mechanism that adjusts an outlet gap of the fixed jaw and the swing jaw by changing a position of the swing jaw with respect to the fixed jaw;

a crusher frame that supports the fixed jaw and the swing jaw;

a cheek plate; and a mounting member that mounts the cheek plate on an inner side of the crusher frame between the fixed jaw and the swing jaw, wherein the outlet gap-adjusting mechanism has an adjustment range and is configured to change the position of the swing jaw with respect to the fixed jaw and thereby adjust the outlet gap such that, in the adjustment range of the outlet gap-adjusting mechanism, the swing jaw covers the mounting member during operation of the jaw crusher, and the swing jaw does not cover the mounting member during exchange of the cheek plate.

3. A jaw crusher, comprising:

a fixed jaw;

a swing jaw that swings with respect to the fixed jaw;

an outlet gap-adjusting mechanism that adjusts an outlet gap between the fixed jaw and the swing jaw by changing a position of the swing jaw with respect to the fixed jaw, the outlet gap-adjusting mechanism being arranged to change the position of the swing jaw with respect to the fixed jaw between a first position that minimizes the outlet gap and a second position that maximizes the outlet gap;

a crusher frame that supports the fixed jaw and the swing jaw;

a cheek plate; and a plurality of mounting members that mount the cheek plate on an inner side of the crusher frame between the fixed jaw and the swing jaw, wherein the outlet gap-adjusting mechanism is configured so that the swing jaw covers one of the mounting members disposed adjacent to an outlet of the jaw crusher when the swing jaw is in the first position, and the swing jaw does not cover the one of the mounting members when the swing jaw is in the second position.

4. The jaw crusher according to claim 1, wherein the cheek plate is a lowermost one of a plurality of cheek plates arranged one above another on a same side of the crusher frame, and wherein each cheek plate is independently mounted to the crusher frame.

5. The jaw crusher according to claim 4, wherein the outlet gap-adjusting mechanism is configured to change the position of the swing jaw with respect to the fixed jaw such that, in the adjustment range of the outlet gap-adjusting mechanism, the swing jaw covers the mounting member of only the lowermost cheek plate during operation of the jaw crusher, and the swing jaw does not cover the mounting member of the lowermost cheek plate during exchange of the cheek plate.

6. The self-propelled crushing machine according to claim 2, wherein the cheek plate is a lowermost one of a plurality of cheek plates arranged one above another on a same side of the crusher frame, and wherein each cheek plate is independently mounted to the crusher frame.

7. The self-propelled crushing machine according to claim 6, wherein the outlet gap-adjusting mechanism is configured to change the position of the swing jaw with respect to the fixed jaw such that, in the adjustment range of the outlet gap-adjusting mechanism, the swing jaw covers the mounting member of only the lowermost cheek plate during operation of the jaw crusher, and the swing jaw does not cover the mounting member of the lowermost cheek plate during exchange of the cheek plate.

8. The jaw crusher according to claim 3, wherein the cheek plate is a lowermost one of a plurality of cheek plates arranged one above another on a same side of the crusher frame, and wherein each cheek plate is independently mounted to the crusher frame.

9. The jaw crusher according to claim 8, wherein the outlet gap-adjusting mechanism is configured so that the swing jaw covers only one of the mounting members of the lowermost cheek plate disposed adjacent to an outlet of the jaw crusher when the swing jaw is in the first position, and the swing jaw does not cover the one of the mounting members of the lowermost cheek plate when the swing jaw is in the second position.

* * * * *